US005555713A

United States Patent [19]

Wussmann et al.

[11] Patent Number: 5,555,713

[45] Date of Patent: Sep. 17, 1996

[54] APPARATUS FOR FEEDING BOBBINS AND BOBBIN CORES TO AND FROM A SPINNING OR TWISTING MACHINE

[75] Inventors: Holger Wussmann, Eislingen; Hartmut Kaak, Ebersbach/Fils; Martin Mense, Holzminden, all of Germany

[73] Assignee: Zinser Textilmaschinen GmbH, Ebersbach/Fils, Germany

[21] Appl. No.: 358,075

[22] Filed: Dec. 15, 1994

[30] Foreign Application Priority Data

Dec. 16, 1993 [DE] Germany ..... 43 43 019.8

[51] Int. Cl.[6] ..... B65H 54/02; D01H 9/10; B65G 23/04

[52] U.S. Cl. ..... 57/281; 198/571; 198/835; 242/35.5 A

[58] Field of Search ..... 57/90, 281, 264; 242/35.5 A, 35.5 R; 198/832, 571, 835

[56] References Cited

U.S. PATENT DOCUMENTS

| | | | |
|---|---|---|---|
| 3,382,659 | 5/1968 | Schulz et al. | 57/281 |
| 4,720,967 | 1/1988 | Guttler | 198/571 X |
| 4,845,937 | 7/1989 | Kiriake et al. | 57/281 |
| 4,964,269 | 10/1990 | Dinkelmann | 57/281 |
| 5,125,224 | 6/1992 | Klaus | 57/281 X |
| 5,136,834 | 8/1992 | Stadele | 57/281 |
| 5,175,990 | 1/1993 | Fritschi et al. | 57/281 |
| 5,179,829 | 1/1993 | Grecksch et al. | 57/90 X |
| 5,299,415 | 4/1994 | Wanger | 57/281 |
| 5,373,689 | 12/1994 | Maeser et al. | 57/90 X |
| 5,426,930 | 6/1995 | Badiali et al. | 57/90 X |

*Primary Examiner*—Michael R. Mansen
*Attorney, Agent, or Firm*—Herbert Dubno

[57] ABSTRACT

A rotary position sensor is connected to the belt of an apparatus for receiving the full bobbins and delivering the empty bobbin cores to both sides of a spinning or twisting machine. The microprocessor control unit has a memory which stores the restarting positions of the belt and, based upon the count in this control unit of the pulses from the sensor, the motor driving the belt is brought to a standstill.

10 Claims, 8 Drawing Sheets

APPARATUS FOR FEEDING BOBBINS AND BOBBIN CORES TO AND FROM A SPINNING OR TWISTING MACHINE

CROSS REFERENCE TO RELATED APPLICATION

This application is related to our commonly owned copending application, Ser. No. 08/358,076 filed Dec. 15, 1994 based upon German application P 43 43 020.1 filed Dec. 16, 1993 and which is incorporated herein by reference.

FIELD OF THE INVENTION

Our present invention relates to an apparatus for feeding bobbin cores and bobbins to and away from a spinning or twisting machine.

BACKGROUND OF THE INVENTION

Conventional apparatus for feeding bobbin cores to and full bobbins or cops away from a spinning or twisting machine can be comprised of a transport belt extending around the spinning or twisting machine and which is controlled to advance to predetermined positions in succession. The transport belt itself can comprise a support belt and a multiplicity of carriers releasably affixed thereon and formed with pins for transporting the bobbins or cops from the workstations of the machine to a removal position or for transporting the bobbin-winding cores or empty sleeves from a supply position to the workstations of the machine. The pins onto which the bobbins or bobbin cores can be placed can, however, be fixedly connected with the transport belt.

The carriers for the cops and bobbin cores are advantageously disposed alternately on the support belt with a spacing at half the spindle pitch (center-to-center inter-spindle spacing of the machine). The number of the carriers for the bobbins and the number of carriers for the bobbin cores each correspond to the number of workstations of the respective spinning or twisting machine. Since such machines generally have the same number of workstations along both longitudinal sides of the machine, the carriers as a rule are so disposed upon the support belt that all of the cops can be transferred to the respective cop-receiving carriers in a single operation from the workstations. After the transfer of the cops, the belt can be moved a half spindle pitch so that a carrier with an empty bobbin core or sleeve is disposed at each workstation.

After a transfer of the empty bobbin sleeve to the workstation, the transport belt is displaced until the first carrier bearing a cop is disposed in the removal position. The cops are then individually removed from their carriers in succession with stepped advance of the transport belt by one spindle pitch after another.

Preferably with an offset of one or more of these cycles, the empty bobbin cores are placed upon the respective carriers in the supply position. For the removal of the cops and the mounting of the empty bobbin sleeves to occur in the same cadence, the distance between the removal position and the supply position of the belt must be a whole number of spindle pitches plus one half of a spindle pitch. The spotting of the individual positions of the transport belt is accomplished in the conventional apparatus with a multiplicity of sensors distributed along the length of the machine and which detect markers on the transport belt at these positions and transmit signals to the control unit upon such detection. The control unit can stop the belt drive motor.

It is a drawback with this conventional apparatus that the requirement for a large number of sensors is concomitant to a high capital cost, especially for the cabling necessary for such sensors. The required lengths of the conductors makes the system highly sensitive to stray electromagnetic signals and increases problems with detrimental effects upon the conductor coverings. A further disadvantage is the need for precise adjustment of the sensors for accurate lining up of the carriers. Unnoticed positional changes in the sensors can give rise to a high error frequency and probability.

In German patent DE 40 05 418 C1, an apparatus is disclosed which can be used for automatic doffing and displacing of the bobbins and bobbin cores from the transport belt to the spindles of the workstation of a spinning or twisting machine and wherein, in place of the multiple sensors previously described, a single absolute value signal generator is provided which is juxtaposed with one of the bobbin pins of the belt. The cost of such an absolute value detector is considerable and the reliability leaves much to be desired.

Reference may also be had to German open application DE 41 13 090 A1 which describes a light curtain system which serves only to detect whether a bobbin or sleeve is at a predetermined position. This system provides speed control in dependence upon production speeds and does not detect the absolute position of the belt or provide any indication as to how such a position could be detected or whether such position may be detected.

OBJECTS OF THE INVENTION

It is the principal object of the present invention, therefore, to provide an improved apparatus for supplying the bobbin sleeves to and removing the full bobbins from a spinning or twisting machine of the type described which is more reliable and does not require as many sensors or as complicated a sensor harness as has been the case heretofore.

It is another object of this invention to provide an improved apparatus for feeding empty cores or sleeves to the spinning or twisting machine and conducting full bobbins therefrom with an endless conveyor arrangement whereby drawbacks of earlier devices are avoided.

SUMMARY OF THE INVENTION

These objects can be achieved, in accordance with the invention in an apparatus which comprises:

an endless transport belt extending around the spinning or twisting machine and provided with:

a drive including a motor operatively connected with the belt for driving same, means for accepting the bobbins from the work stations for movement of the bobbins away from the work stations to a removal position in which the bobbins are removed from the belt, and means for receiving bobbin-winding cores from a supply position and carrying the bobbin-winding cores to the work stations;

a rotary member around which the belt passes in a direction change of the belt and positively engaged by the belt, and a sensor generating signals representing angular displacement of said rotary member as a measure of at least one parameter selected from an absolute position of the belt and a change in position of the belt; and a control unit connected to the sensor and to the drive, controlling the drive, and provided with means receiving the signals and programmed to establish successive starting positions of the belt in response to the sensor signals and a set-point position stored in or calculated in the control unit from the signals.

By providing a rotary signal generating system which is positively coupled to the transport belt at a change in direction thereof, i.e. utilizing one of the wheels of the endless path about which the belt passes, namely, a sprocket or other roller of the belt system, the signal generator can provide an absolute position of the transport belt or signals representing position changes of the transport belt at substantially lower cost than has hitherto been the case. In a preferred embodiment of the invention, the rotary signal generator is a simple low cost incremental rotary position signaller and the absolute position of the transport belt is obtained by resetting a counter each time the belt is brought to standstill and then counting the pulses from this pulse generator starting from the new starting position of the belt. The individual subsequently established positions of the belt can be exactly determined by a comparison of the count with the previously stored value for the setpoint position or a value calculated from the count or a stored data. In either case, of course, he set-point position is defined in the control unit.

Any possible deviation of the actual position of the belt from the respective setpoint position at a particular standstill may result in the generation of an error or deviation value which is used to set the setpoint value for the next standstill of the belt. Alternatively, after a standstill of the belt should there be a deviation of the actual value from the setpoint value, the actual position can be corrected to approach the setpoint position and at least until the incremental correction brings the actual value position within a given difference from the setpoint position, e.g. as described in the aforementioned copending application.

In a preferred embodiment of the invention, the automatic bobbin core supplier and the automatic bobbin remover at the respective removal position and the supply position can generate respective signals indicating the end of the bobbin removal cycle and the core or sleeve supply cycle respectively. In its method aspects, the-method of operating the apparatus can be considered to comprise the Steps of:

(a) driving an endless transport belt extending around the machine and provided with:

a drive including a motor operatively connected with the belt for driving same, means for accepting the bobbins from the work stations for movement of the bobbins away from the work stations to a removal position in which the bobbins are removed from the belt, and means for receiving bobbin-winding cores from a supply position and carrying the bobbin-winding cores to the work stations;

(b) rotating a rotary member around which the belt passes in a direction change of the belt and positively engaged by the belt, past a sensor generating signals representing angular displacement of the rotary member as a measure of at least one parameter selected from an absolute position of the belt and a change in position of the belt; and (c) controlling the drive by receiving the signals and automatically establishing successive starting positions of the belt in response to the sensor signals and a set-point position previously stored or calculated from the signals.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
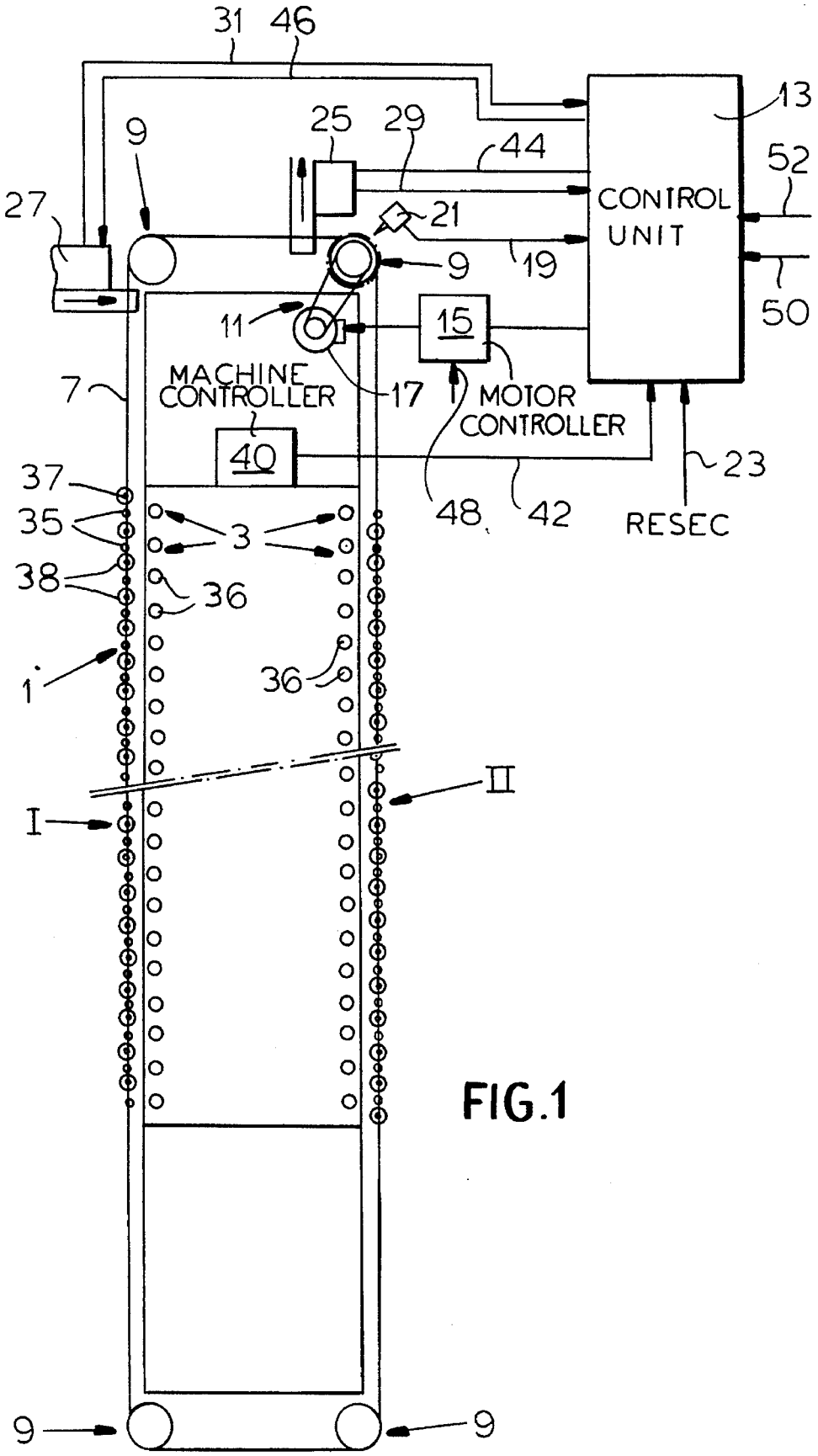
FIG. 1 is a schematic illustration of a spinning or twisting machine provided with the apparatus of the invention for supplying the bobbin-winding cores or sleeves to and removing full bobbins from the machine according to the invention.

FIG. 1 shows schematically a spinning or twisting machine 1 with a multiplicity of workstations or spindles 3 and an apparatus 5 for removing the full bobbins from the machine and supplying empty sleeves or bobbin-winding cores thereto. The apparatus 5 for this purpose comprises an endless transport belt 7 extending around the spinning or twisting machine 1 and which at the four corners of the machine passes around respective direction changing members 9 which can be wheels, such as sprocket wheels, positively entraining or entrained by the cogged belt. One of the wheels 9 is connected with a belt drive 11 operated by an electric motor 17.

On the transport belt 7, as is also apparent from FIG. 1, preferably with a spacing of half the spindle pitch, pins are provided to receive the full cop or bobbin and for receiving the empty sleeve or cores. The transport belt can be so constructed that at least the pins for the full cops are bobbins are provided on carriers which are releasably connected to the belt. This permits the removal of the carrier with the full bobbin or cop for further processing of the yarn.

The apparatus of the invention also comprises a control unit 13 which may be a microprocessor based control unit having an internal memory, which can operate the motor controller 15 for the electric motor 17 of the belt drive 11. The motor controller 15 can, in the simplest case, be a controllable electronic switch which separates the electric motor 17 from its energy supply or connects the electric motor 17 to its energy supply.

The signals which are significant with respect to the control unit include a starting signal supplied by a line 19 from a sensor 21. The sensor 21 generates a train of pulses representing the angular displacement of one of the wheels 9, especially an entrained wheel 9 or the driven wheel 9 as is the case in the embodiment shown, representing the change in position of the belt. The rotary position generator can be an absolute value generator or a simple increment generator, producing a pulse for a unit angular displacement of the member 9 positively engaged with the belt.

In the latter case, the absolute position of the belt 7 is determined by counting the number of pulses from the sensor 21 from a predetermined starting position of the belt. For this purpose, the control unit 13 can comprise a counter for the pulses delivered along line 19. A reset signal 23 which can be applied to the control unit 13 at the initial starting of the apparatus can reset the control unit 13 and its counter to 0.

For the startup to establish the next position of the belt 7, the control unit 13 is provided with a memory. Each of the possible positions of the belt 7 from the starting position (position 0) may be stored in the memory. The positions can also be stored in the memory in the form of differences between two prior positions as digital values.

In any case, the control unit 13 can receive further input signals 29 and 31 from the automatic bobbin removal device 25 and the automatic core setting device 27. The signal 29, for example, indicates that a bobbin removal operation has been completed while the signal 31 indicates that a sleeve setting operation has been completed, i.e. these signals represent transmission of "bobbins removed" and "sleeve set" commands to the control unit 13. Thus at the end of each operation, the control unit 13 is in a position to transmit a signal 33 to the motor controller 13 to begin movement of the belt 5 once again.

Below we have described the process by which the apparatus of the invention operates with reference to the phases of the apparatus shown in FIGS. 2–8.

The starting position, of course, is that shown in FIG. 1 in which at each workstation 3 of the spinning or twisting machine 1 an empty pin 35 is located to receive the fully wound bobbin or cop. Since the spinning or twisting machine usually is provided with a doffer which removes all the bobbins from respective spindles of the equal number of workstation on both longitudinal sides of the machine simultaneously, the number of pins 35 to receive the bobbins 36 and the number of pins 37 carrying the empty sleeves 38 are equal in corresponding stretches I for the left machine side and II for the right machine side.

Figure 2:
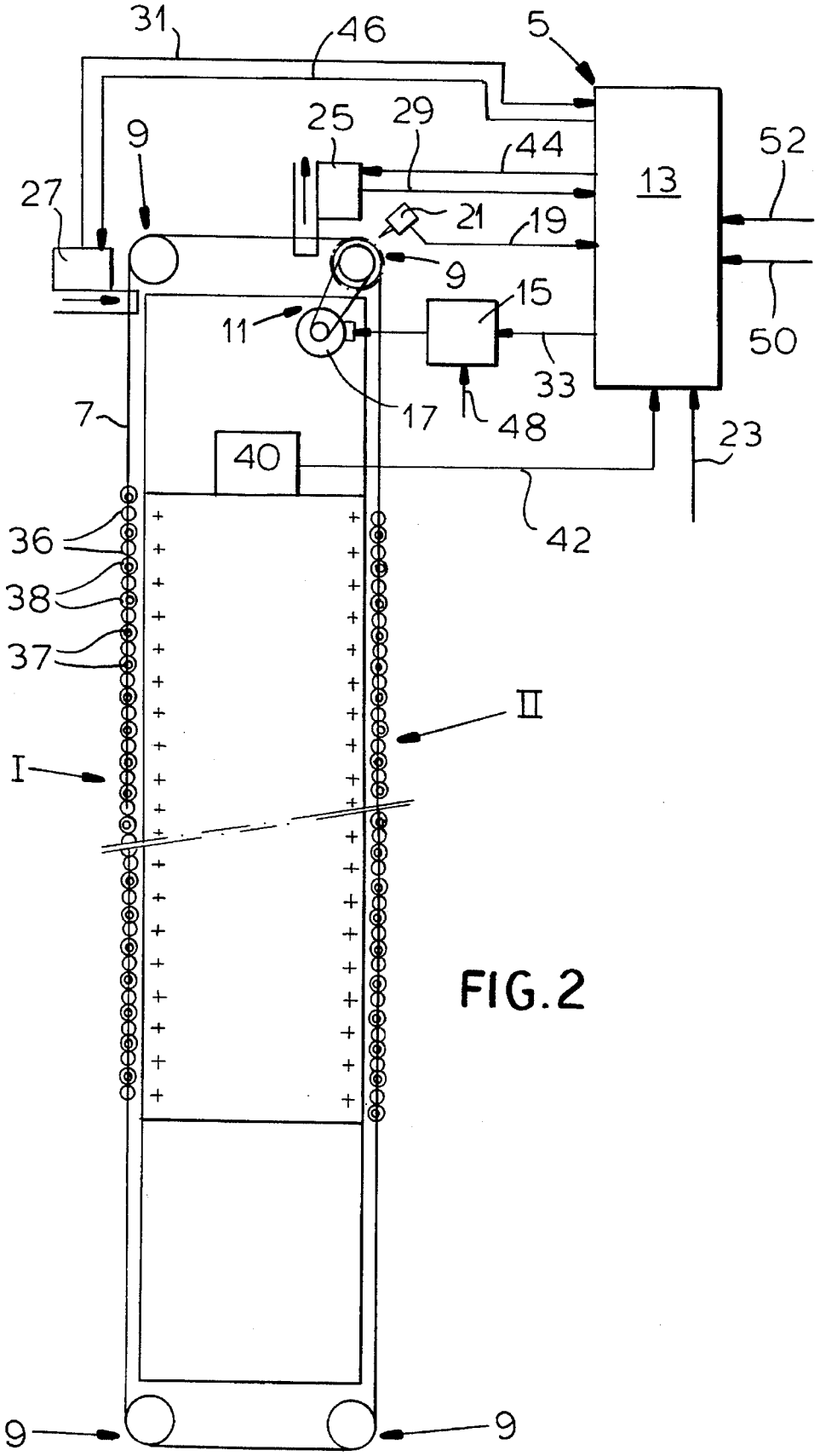
FIG. 2 is a view similar to FIG. 1 illustrating a phase in the operation of the apparatus.
Figure 3:
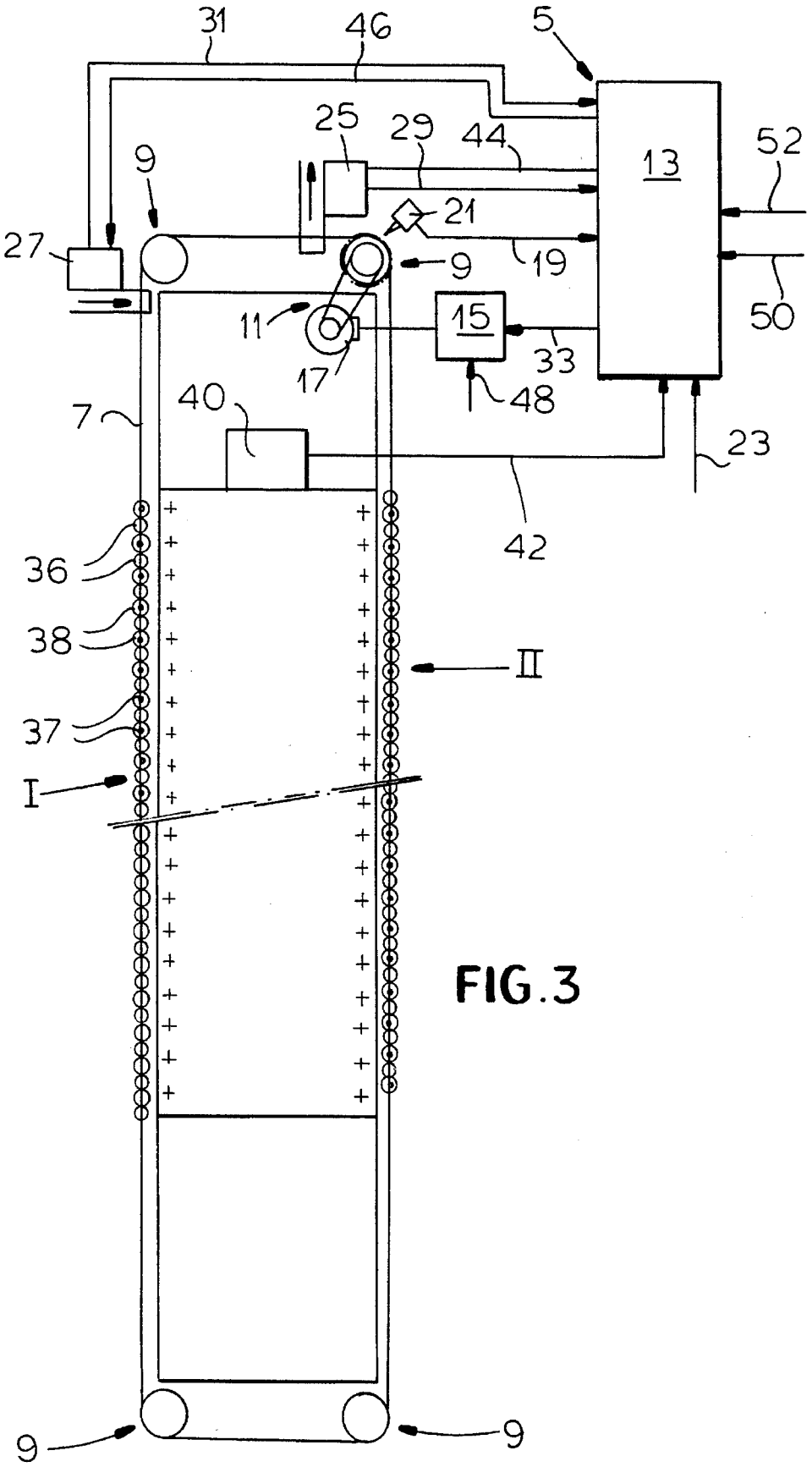
FIG. 3 is a view similar to FIG. 1 illustrating a phase in the operation subsequent to that of FIG. 2.
Figure 4:
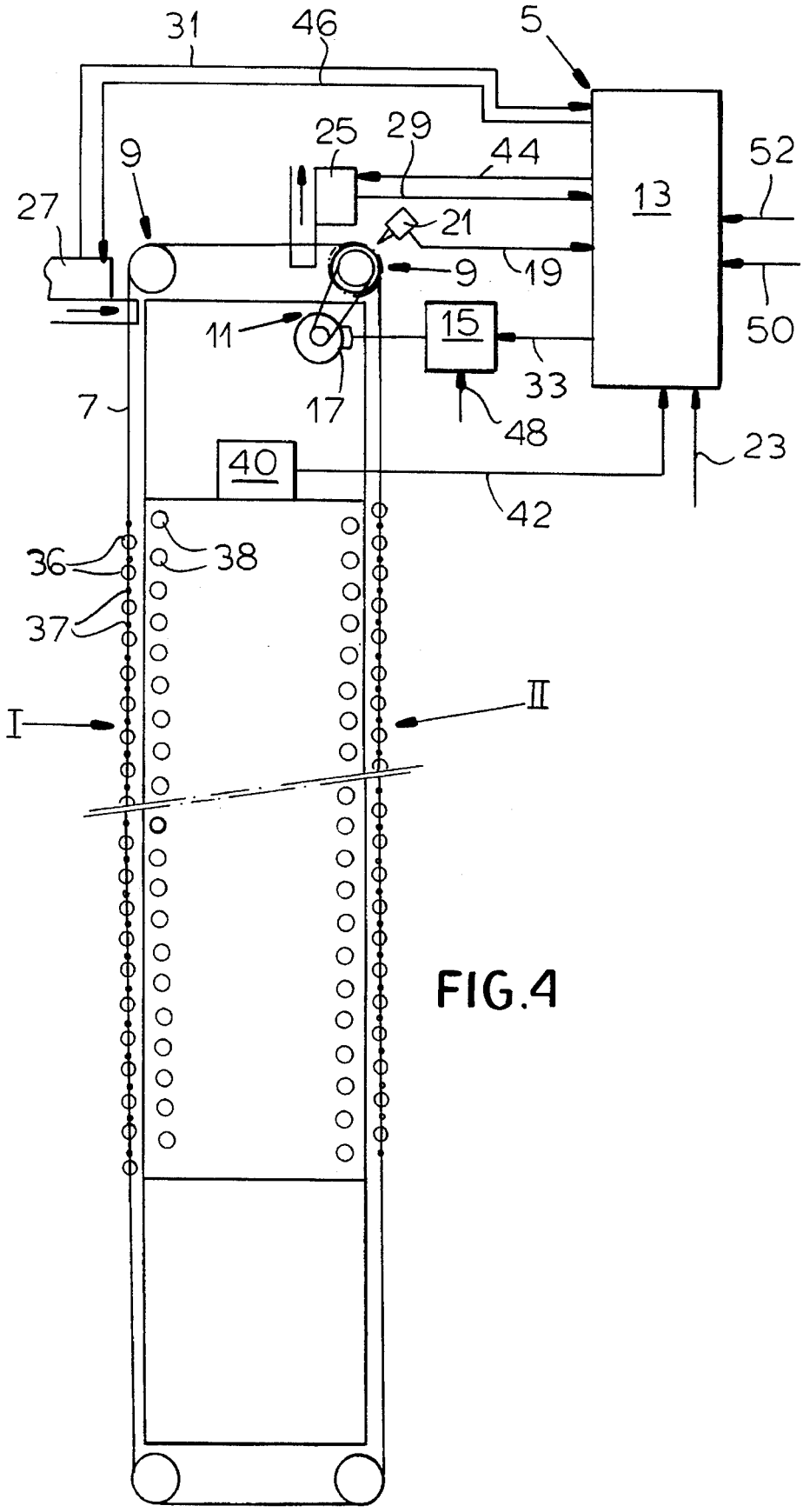
FIG. 4 is a view similar to FIG. 1 illustrating another phase in the operation subsequent to that of FIG. 2.

In this position, the counter of the control unit 13 for the pulses 19 from the sensor 21 has been reset to 0 by a reset signal 23. At this point, a control unit 40 of the machine is operated to transfer all of the bobbins 36 from the respective spindles, placing the bobbins on the pins 35. The control unit 13 then receives a "start" signal 42 from the control unit 40 (FIG. 2). The control unit 13 transmits a "motor on" signal 33 to the motor controller 15 and, upon the drive of the belt 7, the sensor 21 generates pulses which are applied at 19 to the control unit 13 and are counted. The counter value thus represents the actual displacement of the belt and is compared with the stored value for the next position, i.e. the approached setpoint. Upon reaching this position the control unit 13 via the signal 33 "motor off" deactivates the motor and brings the belt 7 to standstill.

From the position shown in FIGS. 1 and 2, the belt 7 is first moved (FIG. 3) by half the spindle pitch so that opposite each empty spindle an empty sleeve or core 38 is disposed. In this position, the control unit 40 operates the mechanism of the machine for transferring the empty sleeves 38 to the respective spindles by removing the sleeves 38 from the pins 37 and placing them on the spindles. The result is the state of the apparatus shown in FIG. 4.

Figure 5:
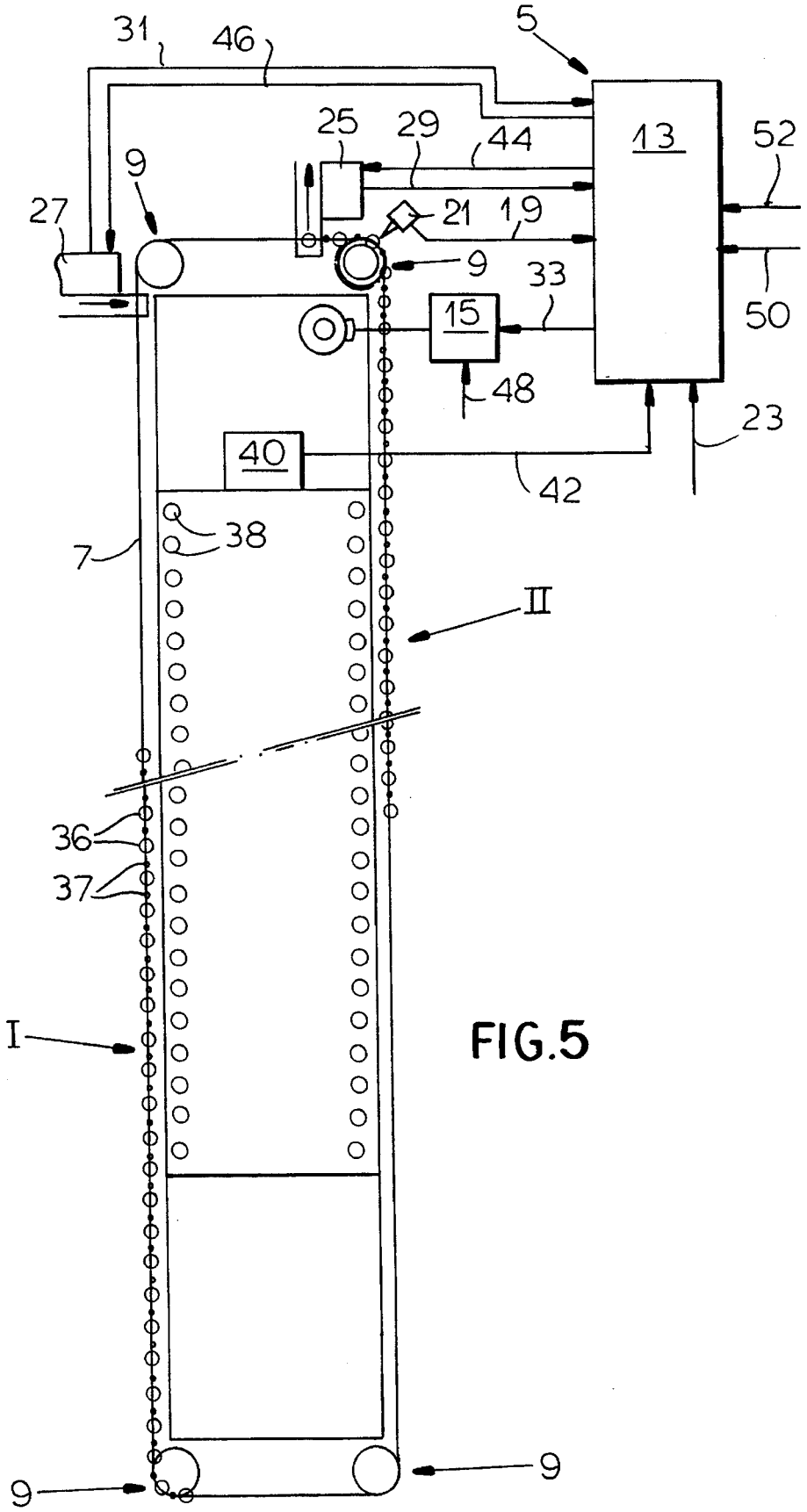
FIG. 5 is a view similar to FIG. 1 illustrating yet another phase in the operation subsequent to that of FIG. 2.

Upon the conclusion of this stage, the control unit 40 transmits another "start" signal to the control unit 13 which, through the latter, results in the application of the "motor on" signal 33 to the motor controller 15. The pulses from the sensor 21 at 19 are again counted and the signal 33 for "motor off" is given by the control unit 13 as soon as the counter value coincides with the stored value for the next position of the belt 7. In this manner, the position shown in FIG. 5 is reached in which the first cop of the stretch II is disposed in the removal position of the bobbin removal device 25.

After reaching this position, the control unit 13 transmits a "remove" signal 44 to the removal device 25 so that the removal device lifts the cop 36 from the respective pin 35 and issues a signal 29 indicating the completion of this step.

After the bobbin removal process has terminated, the removal device 25 transmits the signal "bobbin removed" 29 to the control unit 13. The control unit 13 then causes the belt 7 to move to its next position in an analogous manner. In this position, the second bobbin of the stretch II is in the removal position, i.e. the belt 7 has been moved by one spindle pitch.

Figure 6:
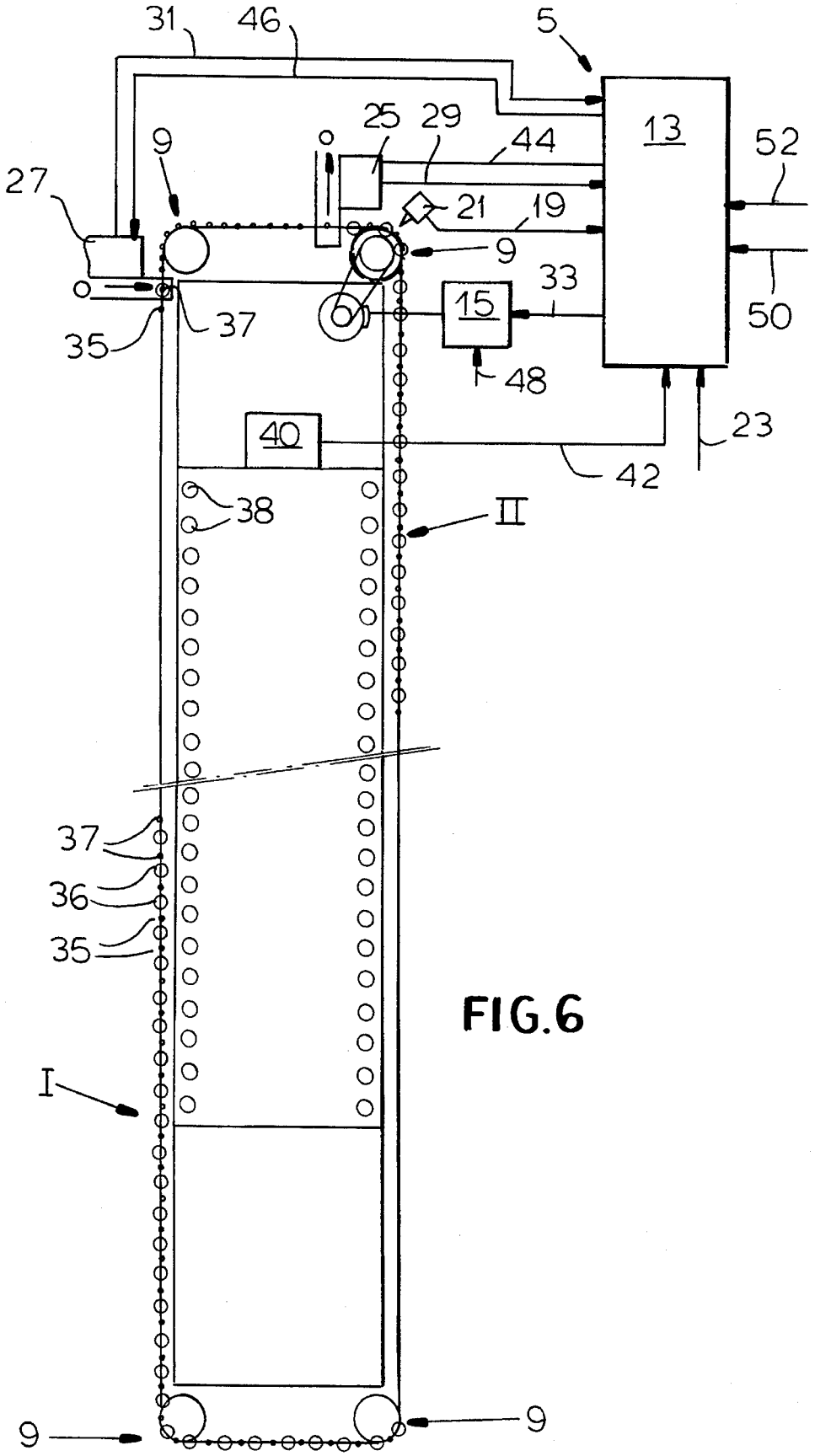
FIG. 6 is a view similar to FIG. 1 illustrating another phase in the operation subsequent to that of FIG. 2.
Figure 7:
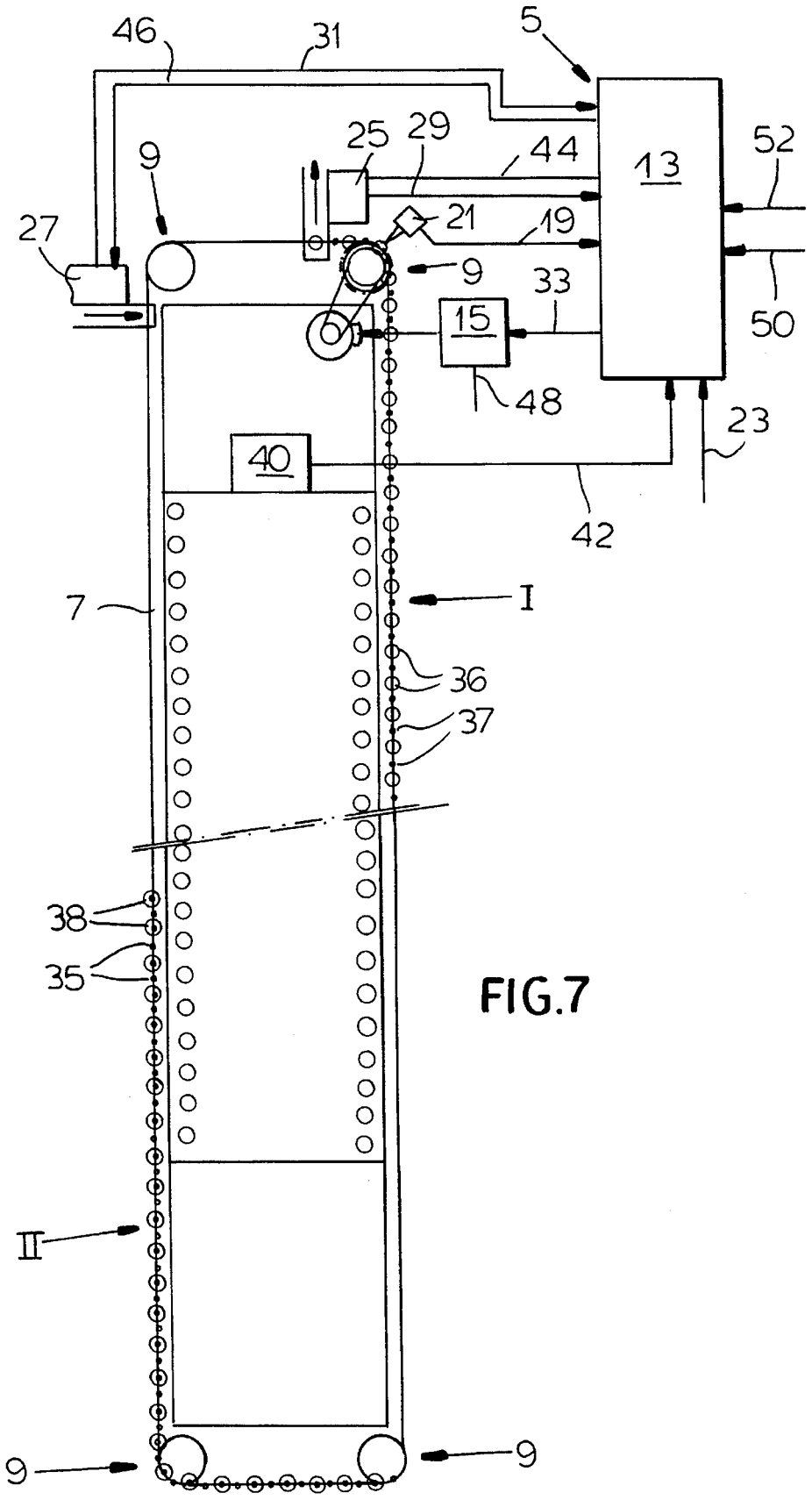
FIG. 7 is a view similar to FIG. 1 illustrating another phase in the operation subsequent to that of FIG. 2.
Figure 8:
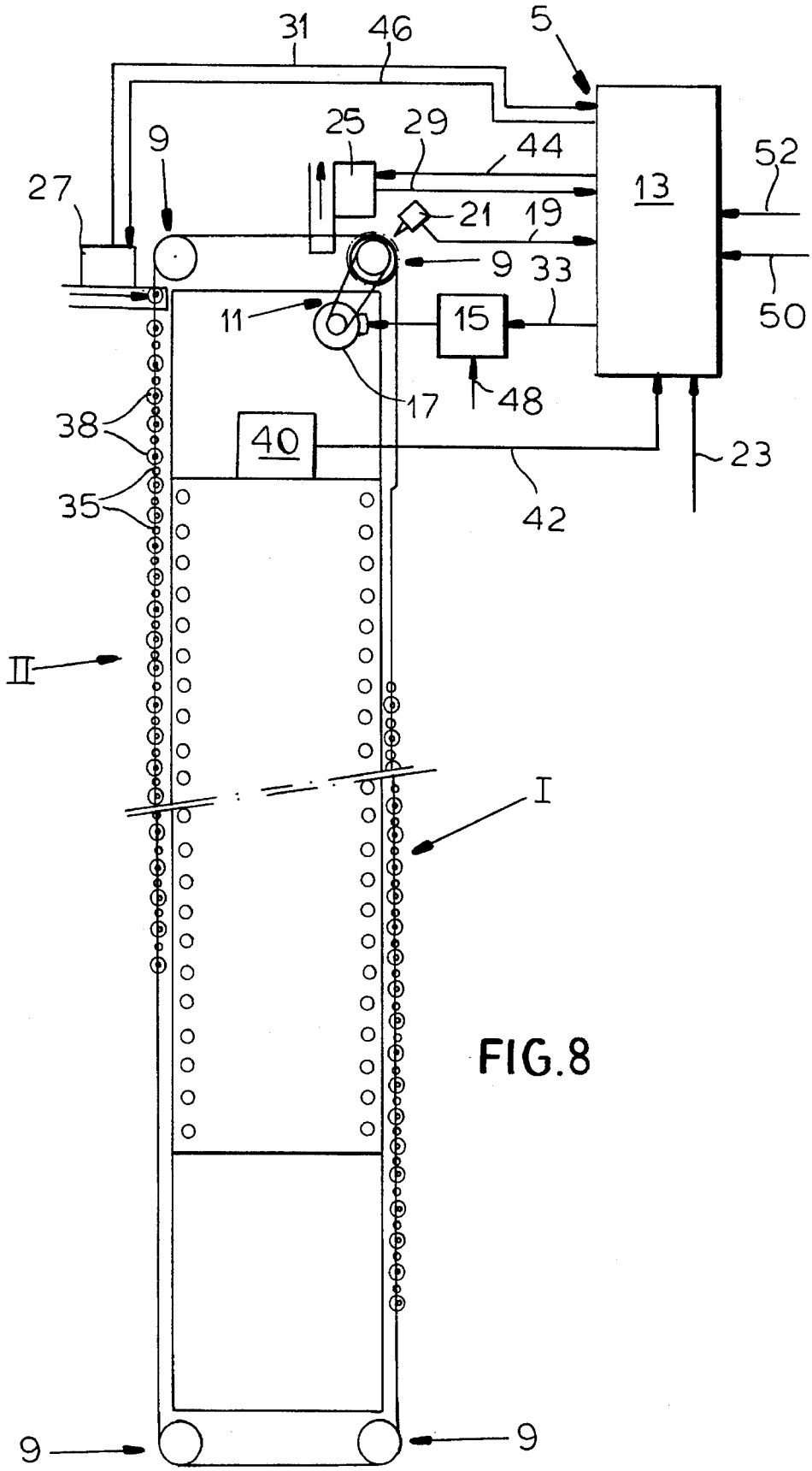
FIG. 8 is a view similar to FIG. 1 illustrating another phase in the operation subsequent to that of FIG. 2.

The further movement by respective values corresponding to one spindle pitch is repeated until the first pin 37 for receiving the first empty sleeve 38 of the stretch II reaches the supply position of the automatic core supply device 27 and a further bobbin 36 is in the bobbin removal position of the bobbin removal device 25 (FIG. 6).

In this case, the control unit 13 provides a "remove" signal to the bobbin removal device 25 and a "supply" signal 46 to the supply device 27. After both the supplying operation and the bobbin removal operation has been completed, the "bobbin removed" signal 29 and the "core supplied" signal 31 have been transmitted to the control unit 13.

In this phase in which both a bobbin has been removed and simultaneously a core has been set on the belt, the control unit 13 generates the "motor on" for the motor controller 15 only when both signals 29 and 31 have been received.

The control unit 13 can repeat this operation for the full number of pins of the stretch II with movement of the belt by a spindle pitch between each such set of operations. A further possibility is to trigger by the movement of the bobbin and sleeve into the respective positions, the bobbin removal and sleeve setting operations independently of separate signals for this purpose from the control unit 13.

Once the last bobbin of the stretch II has been removed, the belt 7 continues to be advanced in steps by one spindle pitch until the last sleeve has been mounted upon a corresponding pin and in this case the control unit 13 need only provide sleeve "supply" signal 31. After the application of the last empty sleeve or core on the corresponding pin of the stretch II, the belt is moved into the position shown in FIG. 7 in which the first bobbin of stretch I is in the removal position in the removal device 25. The removal of the bobbins 36 and the application of the sleeves or core 38 of the stretch I is then repeated in the manner analogous to that which has been described for stretch II.

After the application of the last empty sleeve or core on the corresponding pin of stretch I the belt is returned to the position shown in FIG. 1. In this position, the counter 13 is reset at 0 by a "reset" signal 23 and the aforedescribed process for removing full bobbins and applications of empty cores or sleeves can be repeated.

The inputting of the setpoint value for all of the positions at which starting of the belt 7 is to occur can be effected by calculating the relevant data from, for example, the length of the belt, the number of pins for the bobbins and sleeves, characteristics of the sensor, etc. and the data can be inputted through the microprocessor control unit 13 by an input interface. Preferably, however, the inputting of these values is effected by a teach in process in which starting from the position shown in FIG. 1, after resetting of the counter, the belt is moved into the respective positions and the counter values for each of the positions are then stored in memory.

The motor controller 15 can have a further input 48 with which, for example, a manual signal can be applied for "motor on" and "motor off" states. The control unit 13 can receive an "acceptance" signal 50 to instruct the control units 13 to register the corresponding count of the counter. Switchover between a normal operating mode and the teach in mode can be effected by a mode signal applied at 52 which can switch over between "teach in" and "normal" operations.

The "teaching-in" is usually effected at a reduced speed so that a highly exact count can represent the setpoint positions. In normal operation, however, the speed is increased so that the apparatus will operate at maximum efficiency.

To avoid effects from inertia, the motor can be brought to standstill when the count corresponds to the setpoint less an amount necessary to allow for overrunning of the belt beyond motor shutdown.

An automatic correction of the apparatus can be achieved, should there be an error or deviation at a particular actual value from the setpoint value after the motor has been brought to a standstill, by correcting the setpoint position by an amount corresponding to this deviation in a number of cycles (see the aforementioned application). It will also be understood that the correction can be accomplished by using the new startup position as a basis for adjusting the setpoint position subsequently for adjustment of the next setpoint position. The greatest precision, however, is achieved with the first mentioned approach or a combination of the two.

In further possibilities, after each standstill of the belt, possible deviation of the actual position of the belt 7 from the setpoint position can be detected and the actual position of the belt corrected incrementally for as long as is required to bring the actual position to be less than a predetermined amount (permissible tolerance) from the setpoint position. This provides an iterative process for approaching a setpoint position.

The processes for correction can be combined, of course, so that the iterative processes effected first from one side and then from the opposite side of the setpoint position. This ensures an exact arrival at the setpoint positions even when the speed of the belt is relatively high without requiring control of the speed or regulation thereof. It also provides the advantage that a simple inexpensive drive may be used, for example a simple asynchronous motor, controlled only by on/off connection to an energy supply. A control of the energy supply network to the motor is thus not necessary.

We claim:

1. An apparatus for feeding bobbin-winding cores and bobbins to and from a textile machine having regularly spaced work stations on opposite longitudinal sides of the machine, said apparatus comprising:

an endless transport belt extending around said machine and provided with:

a drive including a motor operatively connected with the belt for driving same, means for accepting said bobbins from said work stations for movement of said bobbins away from said work stations to a removal position in which said bobbins are removed from said belt, and means for receiving bobbin-winding cores from a supply position and carrying said bobbin-winding cores to said work stations;

a rotary member around which said belt passes in a direction change of said belt and positively engaged by said belt, and a sensor generating signals representing angular displacement of said rotary member as a measure of at least one parameter selected from an absolute position of said belt and a change in position of said belt; and a control unit connected to said sensor and to said drive, controlling said drive, and provided with means receiving said signals and programmed to establish successive starting positions of said belt in response to said sensor signals and a set-point position in said control unit said sensor being an incremental angular position generator outputting a succession of pulses upon rotation of said rotary member, and said control unit being provided with means for counting pulses from said sensor after starting of said belt and for comparing a count value with a next set-point position, and upon agreement between said count value and said next set-point position, the drive is brought to standstill.

2. The apparatus defined in claim 1 wherein said means for counting is a counter which is reset at each starting position of said belt.

3. The apparatus defined in claim 1, further comprising:

an automatic removal device at said removal position for removing said bobbins from said belt;

an automatic supply device at said supply position for setting said bobbin-winding cores on said belt; and means in said devices for applying to said control unit respective signals representing termination of a bobbin-removal operation and a core-setting operation.

4. The apparatus defined in claim 1 wherein the control unit includes means for detecting a possible deviation of an actual position of said belt from a set-point position upon a standstill of the belt, and means for adjusting the next setpoint position by an amount corresponding to the deviation.

5. The apparatus defined in claim 1 wherein said control unit includes means for detecting a possible deviation of an actual position of said belt from a set-point position upon a standstill of the belt, and means for adjusting the actual position incrementally and until the actual value deviates from a respective set-point value by less than a predetermined value.

6. A method of operating an apparatus for feeding bobbin-winding cores and bobbins to and from a textile machine having regularly spaced work stations on opposite longitudinal sides of the machine, said method comprising the steps of:

(a) driving an endless transport belt extending around said machine and provided with:

a drive including a motor operatively connected with the belt for driving same, means for accepting said bobbins from said work stations for movement of said bobbins away from said work stations to a removal position in which said bobbins are removed from said belt, and means for receiving bobbin-winding cores from a supply position and carrying said bobbin-winding cores to said work stations;

(b) rotating a rotary member around which said belt passes in a direction change of said belt and positively engaged by said belt, past a sensor generating signals representing angular displacement of said rotary member as a measure of at least one parameter selected from an absolute position of said belt and a change in position of said belt; and (c) controlling said drive by receiving said signals and automatically establishing successive starting positions of said belt in response to said sensor signals and a set-point position, said signals being incremental angular position pulses, and said pulses are counted after starting of said belt and a count value is compared with a next set-point position, and upon agreement between said count value and said next set-point position, the drive is brought to standstill.

7. The method defined in claim 6 wherein said count value is reset at each starting position of said belt.

8. The method defined in claim 6 wherein:

an automatic removal device is provided at said removal position for removing said bobbins from said belt;

an automatic supply device is provided at said supply position for setting said bobbin-winding cores on said belt; and said method further comprises the step of: generating respective signals representing termination of a bobbin-removal operation and a core-setting operation.

9. The method defined in claim 6, further comprising the step of:

detecting a possible deviation of an actual position of said belt from a set-point position upon a standstill of the belt, and adjusting the next set-point position by an amount corresponding to the deviation.

10. The method defined in claim 6, further comprising the step of:

detecting a possible deviation of an actual position of said belt from a set-point position upon a standstill of the belt, and adjusting the actual position incrementally and until the actual value deviates from a respective set-point value by less than a predetermined value.

* * * * *